US005513480A

United States Patent [19]

Tsoi

[11] Patent Number: 5,513,480

[45] Date of Patent: May 7, 1996

[54] DEVICE FOR EXHAUSTING AIR AND MOISTURE FROM A CONTAINER

[76] Inventor: Hok K. Tsoi, 1F, 125-6, Sec. 1, San Min Rd., Taichung, Taiwan

[21] Appl. No.: 384,581

[22] Filed: Jan. 3, 1995

[51] Int. Cl.[6] ..... B65B 31/04

[52] U.S. Cl. ..... 53/510; 53/79

[58] Field of Search ..... 53/405, 408, 403, 53/510, 432, 79, 101

[56] References Cited

U.S. PATENT DOCUMENTS

| | | | |
|---|---|---|---|
| 29,582 | 8/1860 | Gill | 53/405 |
| 2,349,588 | 5/1944 | Brand | 53/405 |
| 2,890,810 | 6/1959 | Rohling | 53/405 X |
| 5,121,590 | 6/1992 | Scanlan | 53/510 |
| 5,338,166 | 8/1994 | Schultz | 53/510 X |
| 5,364,241 | 11/1994 | Schultz | 53/510 X |
| 5,396,751 | 3/1995 | Chi | 53/510 |

*Primary Examiner*—James F. Coan

[57] ABSTRACT

A device for exhausting air and moisture from a container is disposed in a receiving recess of a container lid. The device comprises a braking member provided on the top thereof with a pressing body and at the bottom with a retaining body engageable with an airtight cushion. The braking member is further provided at the bottom thereof with a columnar body extending through a through hole of the receiving recess to fasten with a locating block, so as to enable the airtight cushion to become attached to the through hole of the receiving recess. The device is capable of working with an air pump or a rotatable air pump set to create a vacuum in the container.

3 Claims, 11 Drawing Sheets

DEVICE FOR EXHAUSTING AIR AND MOISTURE FROM A CONTAINER

FIELD OF THE INVENTION

The present invention relates to a device for use in creating a vacuum in a container.

BACKGROUND OF THE INVENTION

The conventional method of preserving the freshness of food in a container is to cap the container in an airtight manner; nevertheless such a method is rather limited in design in that there are air and moisture in the container, and that the food kept in the container can not be therefore kept fresh for a long time. An improved method of preserving the freshness of food in a container is to use a pump to exhaust air and moisture from the container so as to create a vacuum in the container. The lid of the container is therefore caused by the vacuum to deform inwards so that the lid and the container are engaged in an airtight manner. Such an improved method as described is effective in preserving the freshness of food; nevertheless the method is rather complicated. In addition, the pump and the container are separated that the pump is not always available when needed.

SUMMARY OF THE INVENTION

It is therefore the primary objective of the present invention to provide a device for exhausting air and moisture from a container. The device is simple in construction and can be used easily.

It is another objective of the present invention to provide a device for exhausting air and moisture from a container. The device is conveniently attached to the lid of the container so as to facilitate the pumping of the container.

The foregoing objectives, features and advantages of the present invention will be more readily understood upon a thoughtful deliberation of the following detailed description of the present invention in conjunction with the accompanying drawings.

DETAILED DESCRIPTION OF THE INVENTION

Figure 1:
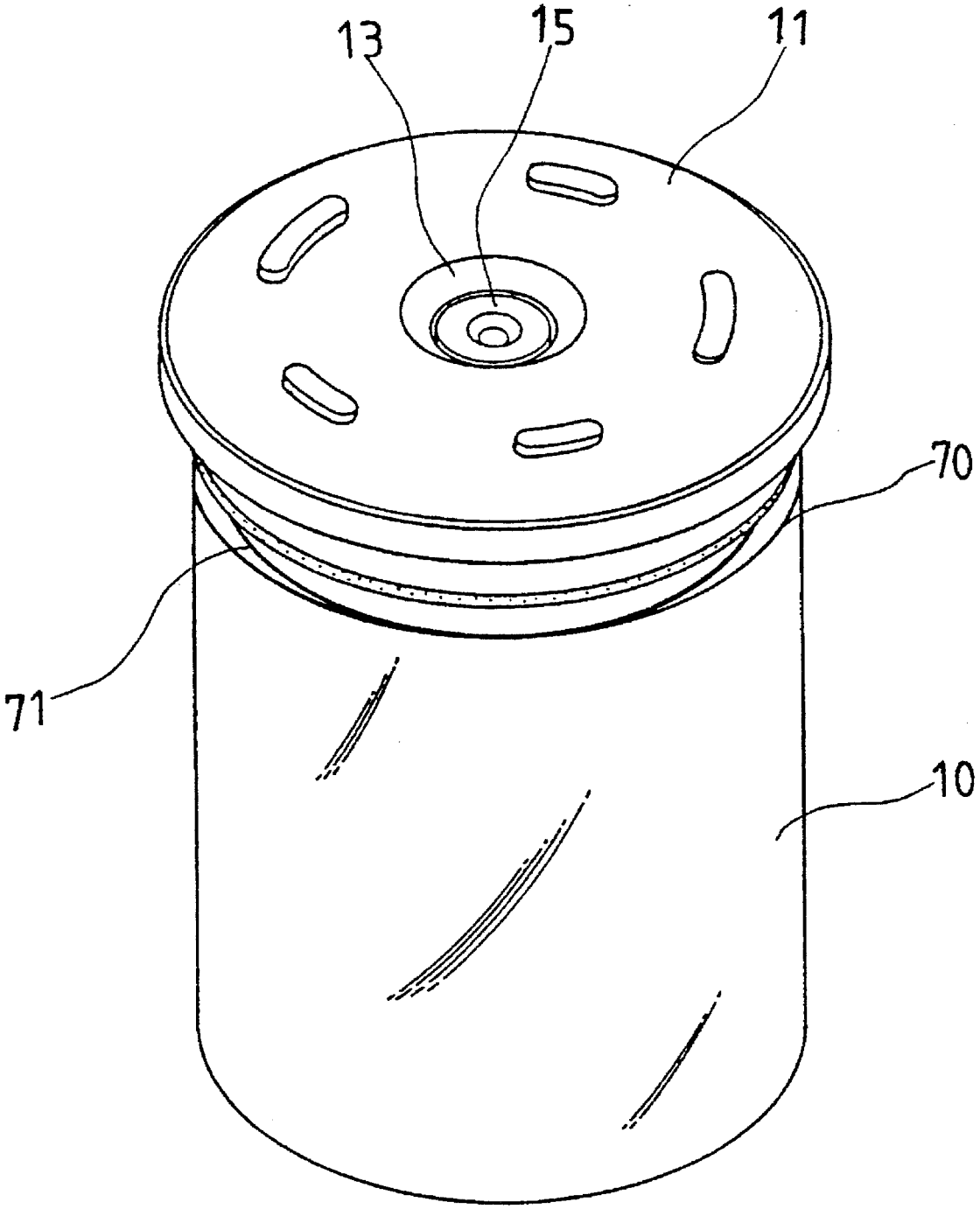
FIG. 1 shows a perspective view of the present invention.

As shown in FIGS. 1–4, a device for exhausting air and moisture of the present invention is disposed in a slot 13 of a receiving recess 12 of a lid 11 of a container 10. The device of the present invention comprises the component parts, which are described hereinafter. A braking member 14 is located in the receiving recess 12 of the lid 11 such that the braking member 14 is kept an appropriate distance from the peripheral wall of the receiving recess 12. The braking member 14 is provided integrally at the top thereof with a pressing body 15 and at the bottom thereof with a retaining body 16 which has a flat surface 17 located at the center of the bottom thereof and has a bevel 18 located peripherally. The retaining body 16 is further provided centrally at the bottom thereof with a columnar body 19 extending downwards to pass through a through hole 20 located centrally at the bottom of the receiving recess 12 of the lid 11.

An airtight cushion 21 of an elastic material is provided centrally with a longitudinal hole 22 and is further provided therein with a retaining space enabling the columnar body 19 of the braking member 14 to enter from the top 24 of the airtight cushion 21 before emerging from the bottom of the airtight cushion 21. The retaining body 16 of the braking member 14 is received in the retaining space of the airtight cushion 21 while the top 24 of the airtight cushion 21 is located between the pressing body 15 and the retaining body 16. The airtight cushion 21 is provided at the bottom thereof with a flat surface 25 and is further provided peripherally with a bevel 26. The flat surface 25 is slightly larger in size than the through hole 20 of the receiving recess 12.

A locating block 27 is provided at the top thereof with a plurality of ventilation grooves 28 and is fastened with the columnar body 19 of the braking member 14 so as to locate the device securely in the receiving recess 12 of the lid 11 such that the device can be moved upwards and downwards.

Figure 3:
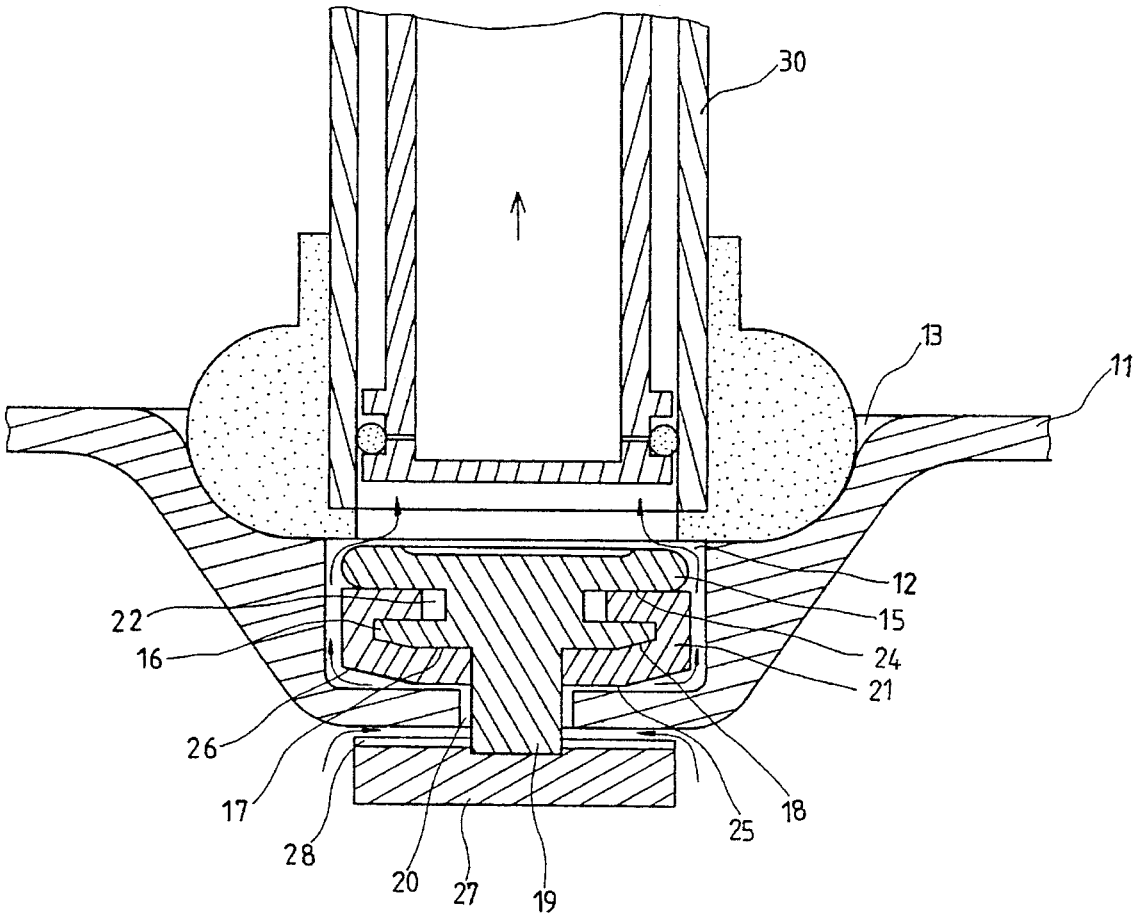
FIG. 3 shows a sectional schematic view of the exhausting action of the present invention.
Figure 4:
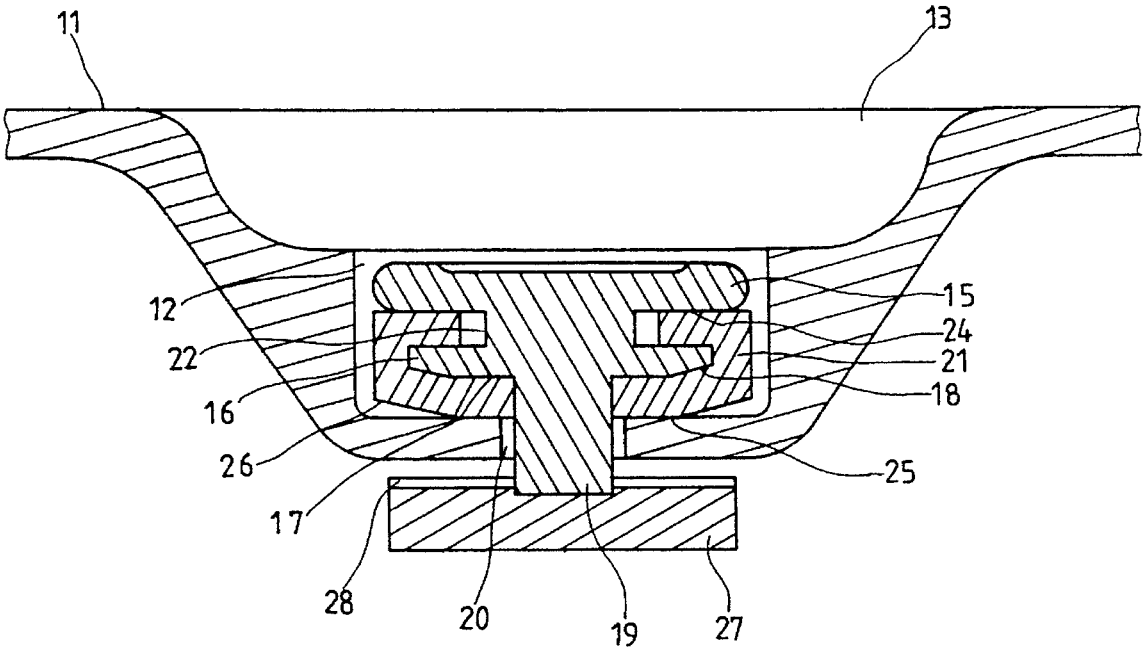
FIG. 4 shows a sectional schematic view of the airtight effect of the present invention.
Figure 5:
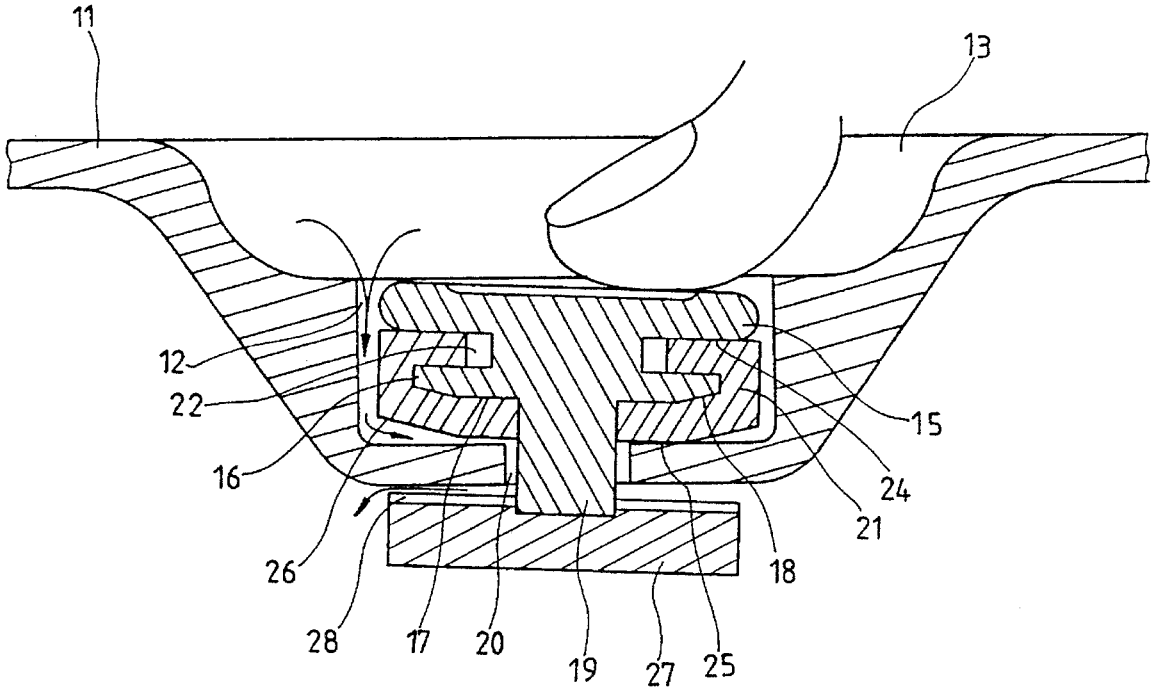
FIG. 5 shows a sectional schematic view of the pressure leaking effort of the present invention.

As illustrated in FIG. 3, the device of the present invention is capable of exhausting air and moisture from a container in conjunction with an air pump 30, which is inserted at the bottom end thereof into the slot 13 of the receiving recess 12 of the lid 11 without making contact with the top of the braking member 14. As the air pump 30 is caused to move upwards, the device of the present invention is forced to move upwards accordingly, thereby bringing about the opening of the through hole 20 of the receiving recess 12 by the flat surface 25 of the airtight cushion 21. As a result, air in the container 10 is allowed to enter the receiving recess 12 via the top or the ventilation grooves 28 of the locating block 27. The air is then exhausted by the air pump 30 via the gap between the peripheral wall of the receiving recess 12 and the device of the present invention. As the air pump 30 is stopped, a vacuum is created in the container 10, thereby causing the flat surface 25 of the airtight cushion 21 to seal off the through hole 20 of the receiving recess 12 of the container lid 11, as shown in FIG. 4. However, the through hole 20 of the receiving recess 12 of the container lid 11 can be also caused to open up instantly by pressing with a finger the side of the pressing body 15 of the braking member 14 so as to cause the airtight cushion 21 to tilt be means of the bevel 26, thereby bringing about the release of the pressure in the container 10, as illustrated in FIG. 5.

Figure 6:
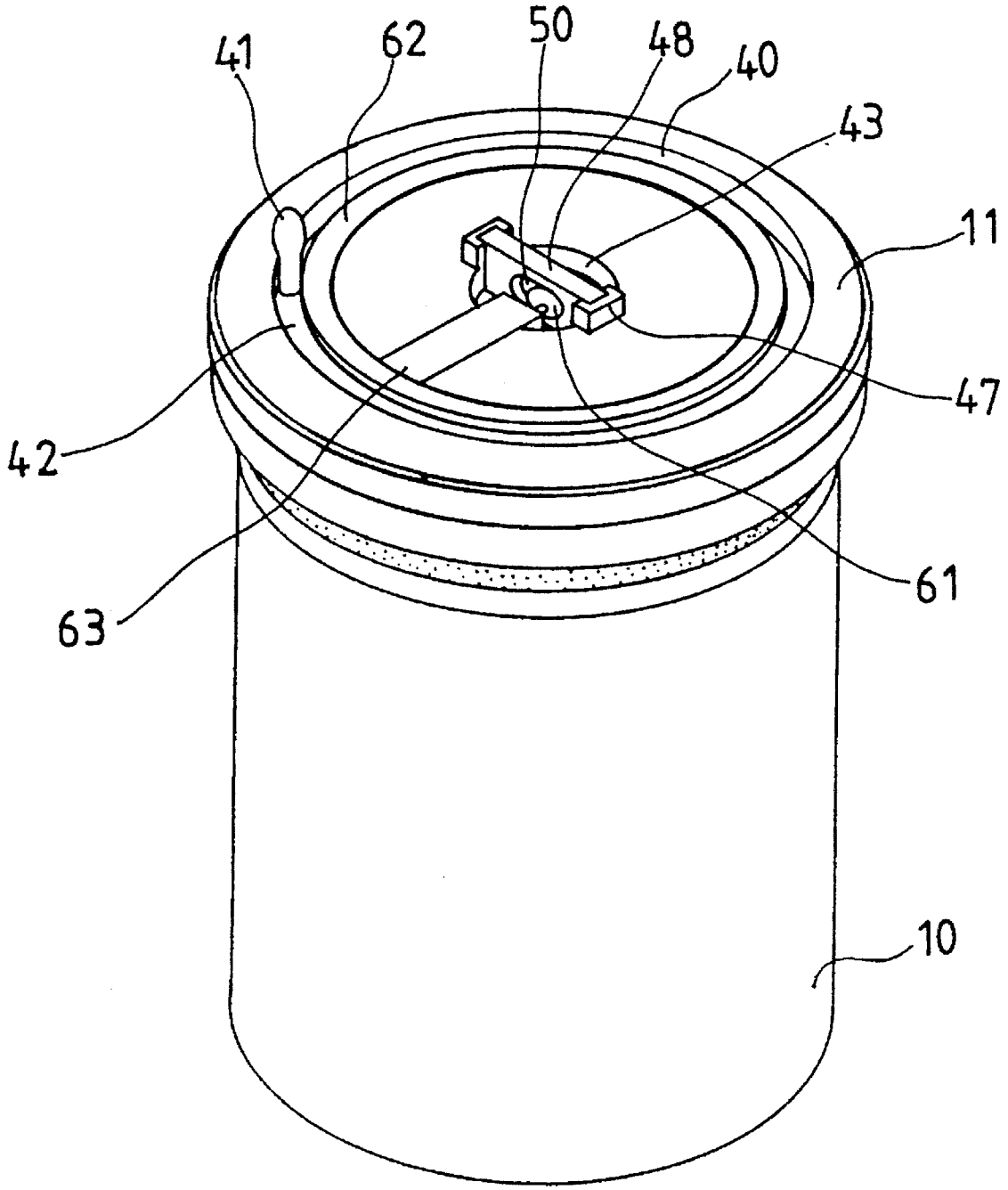
FIG. 6 shows a perspective view of the present invention in combination with a rotatable air pump set.
Figure 7:
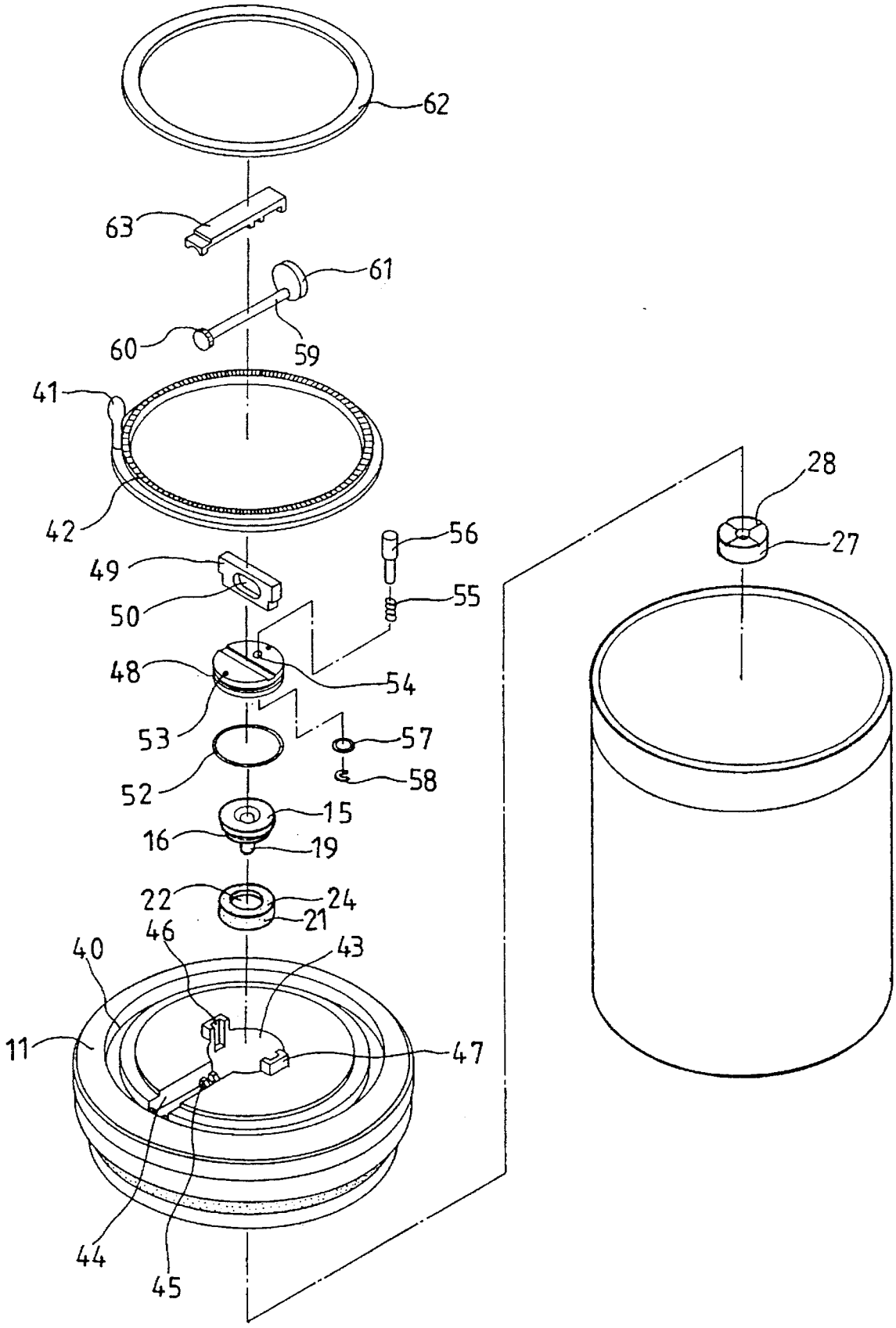
FIG. 7 shows an exploded view of the present invention as shown in FIG. 6.

As shown in FIGS. 6 and 7, the device of the present invention is capable of exhausting air and moisture from a container in conjunction with a rotatable air pump set. The container lid 11 is provided in the top surface thereof with a round slot 40 in which a toothed collar 42 is disposed. The toothed collar 42 is provided with a handle 41. In addition, the receiving recess 12 of the container lid 11 is provided with an air pump receiving cell 43 which is in turn provided with an elongate slot 44 extending from one side thereof toward the round slot 40. The elongate slot 44 is provided at the bottom thereof with two arcuate projections 45. The air pump receiving cell 43 is further provided on the upper edge thereof with two protuberances 47 which are opposite in location to each other and are provided respectively with a longitudinal guide slot 46, thereby enabling the air pump receiving cell 43 to contain an air pump 48, which is located on the top of the device of the present invention and is provided on the top thereof with a guide member 49 fastened thereto. The guide member 49 has two longitudinal ends, which are fitted respectively into the longitudinal guide slots 46 of the two protuberances 47. The guide member 49 is provided horizontally with an oval hole 50 facing the elongate slot 44. The air pump 48 is provided peripherally with an air hole 51 in communication with another air hole 53 located in the top of the air pump 48. Located under the air pump 48 is a cushion 52. The air pump 48 is further provide in one side of the top thereof with a fish-eye hole 54 which is dimensioned to receive therein a spring 55 fitting over a pressure releasing rod 56. The pressure releasing rod 56 is fitted at the bottom end thereof into a cushion 57 and a washer 58 and is located an appropriate distance over the top of the braking member 14. A control shaft 59 is disposed in the elongate slot 44 such that a gear 60 mounted on one end of the control shaft 59 is engageable with the toothed collar 42, and that an eccentric wheel 61 mounted on another end of the control shaft 59 is located in the oval hole 50 of the guide member 49. The round slot 40 and the elongate slot 44 are covered respectively with a covering ring 62 and a locating piece 63 for locating the toothed collar 42 and the control shaft 59.

Figure 8:
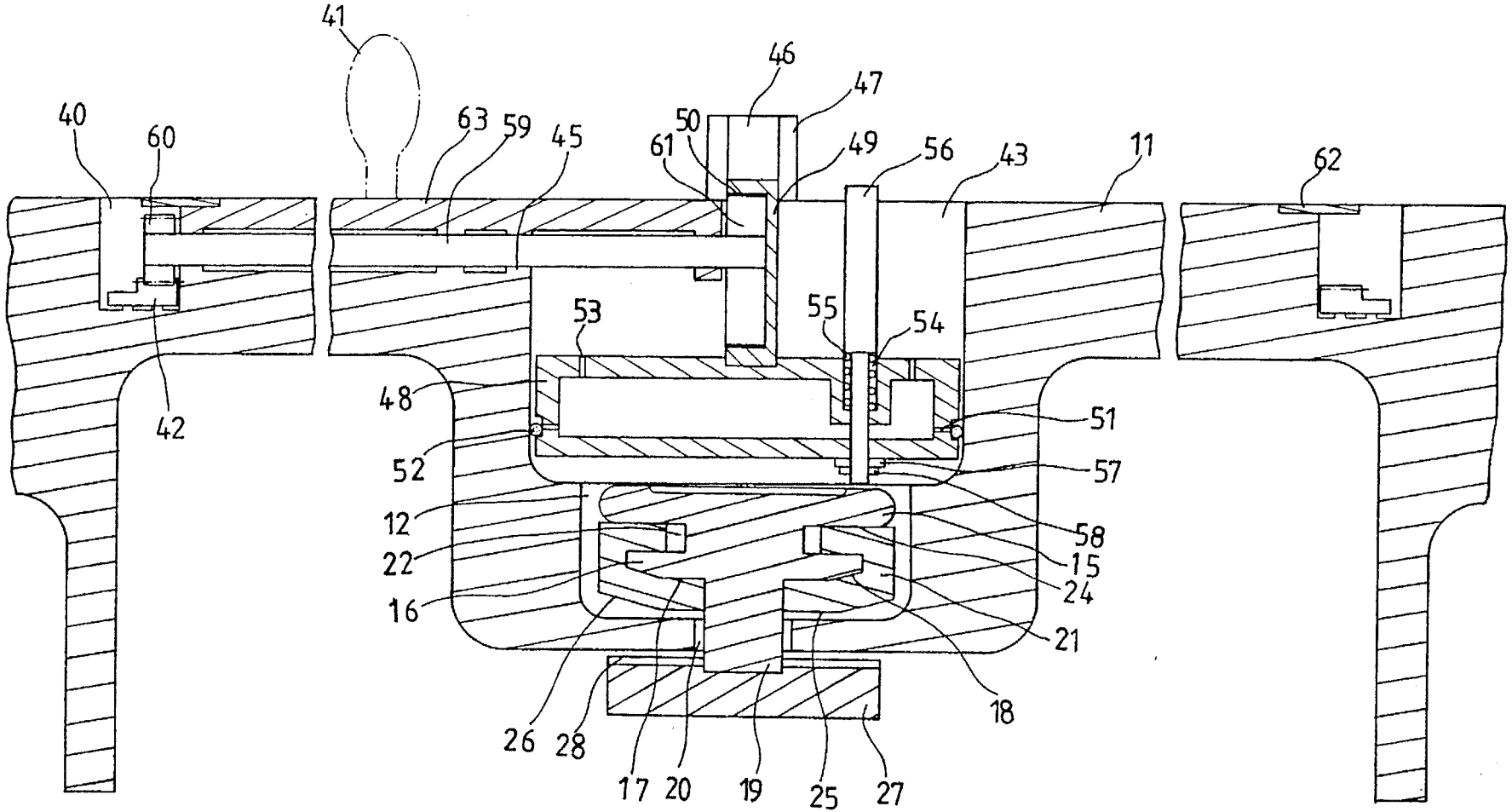
FIG. 8 shows a sectional schematic view of the present invention as shown in FIG. 6.
Figure 9:
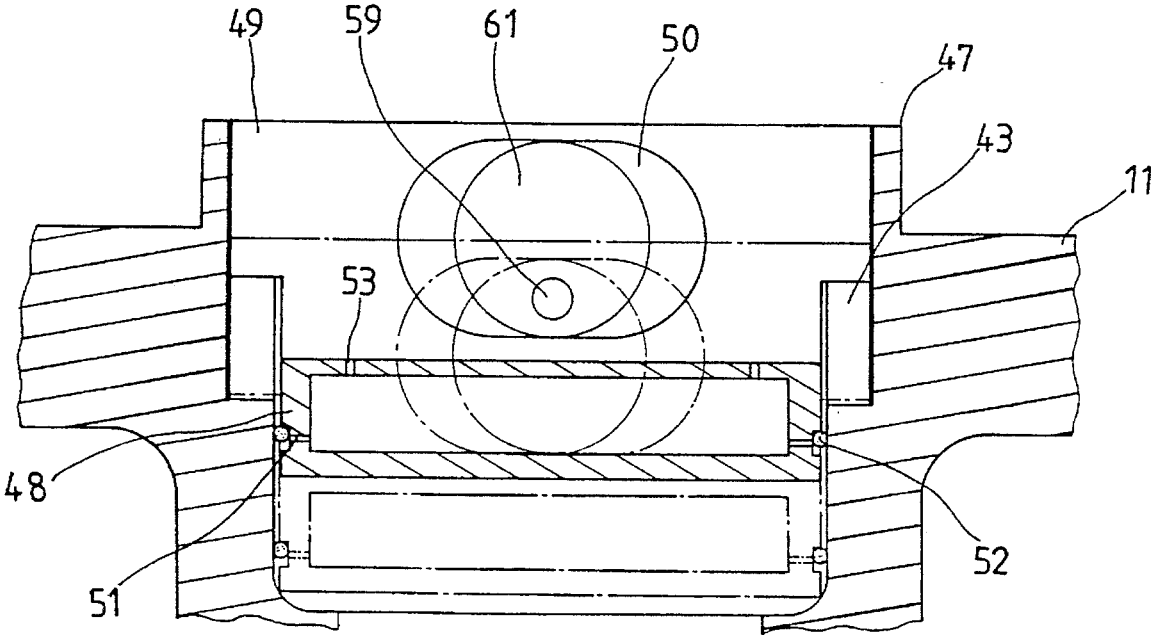
FIG. 9 shows a schematic view of the exhausting action of the present invention as shown in FIG. 6.
Figure 10:
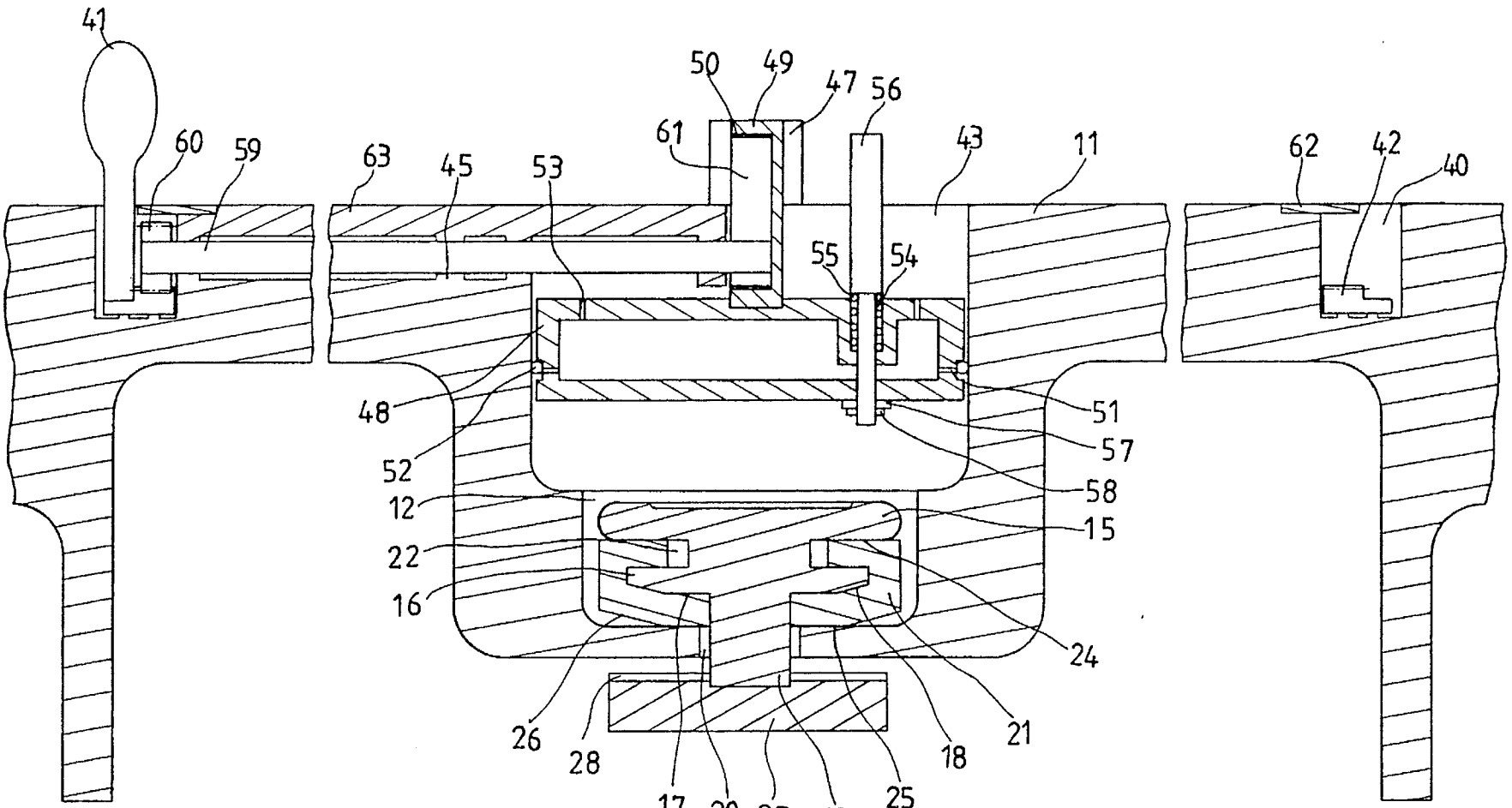
FIG. 10 shows a schematic view of the airtight effect of the present invention as shown in FIG. 6.

As illustrated in FIGS. 8 and 9, the rotatable air pump set has advantages over the air pump 30 in that the exhausting of air in the container 10 can be attained easily and rapidly by turning the toothed collar 42 of the rotatable air pump set. As described previously, the toothed collar 42 is engaged with the gear 60 which is mounted on one end of the control shaft 59 having another end on which the eccentric wheel 61 is mounted. It is therefore readily apparent that the rotating action of the toothed collar 42 can actuate the gear 60, which in turn can actuate the eccentric wheel 61 to rotate. The eccentric wheel 61 is located in the oval hole 50 of the guide member 49. As the eccentric wheel 61 is caused to turn, the guide member 49 is actuated to cause the air pump 48 to move up and down so as to bring about the action of exhausting air and moisture in the container 10, as shown in FIG. 10. The device of the present invention is fastened to the container lid 11 and can not be therefore misplaced.

Figure 11:
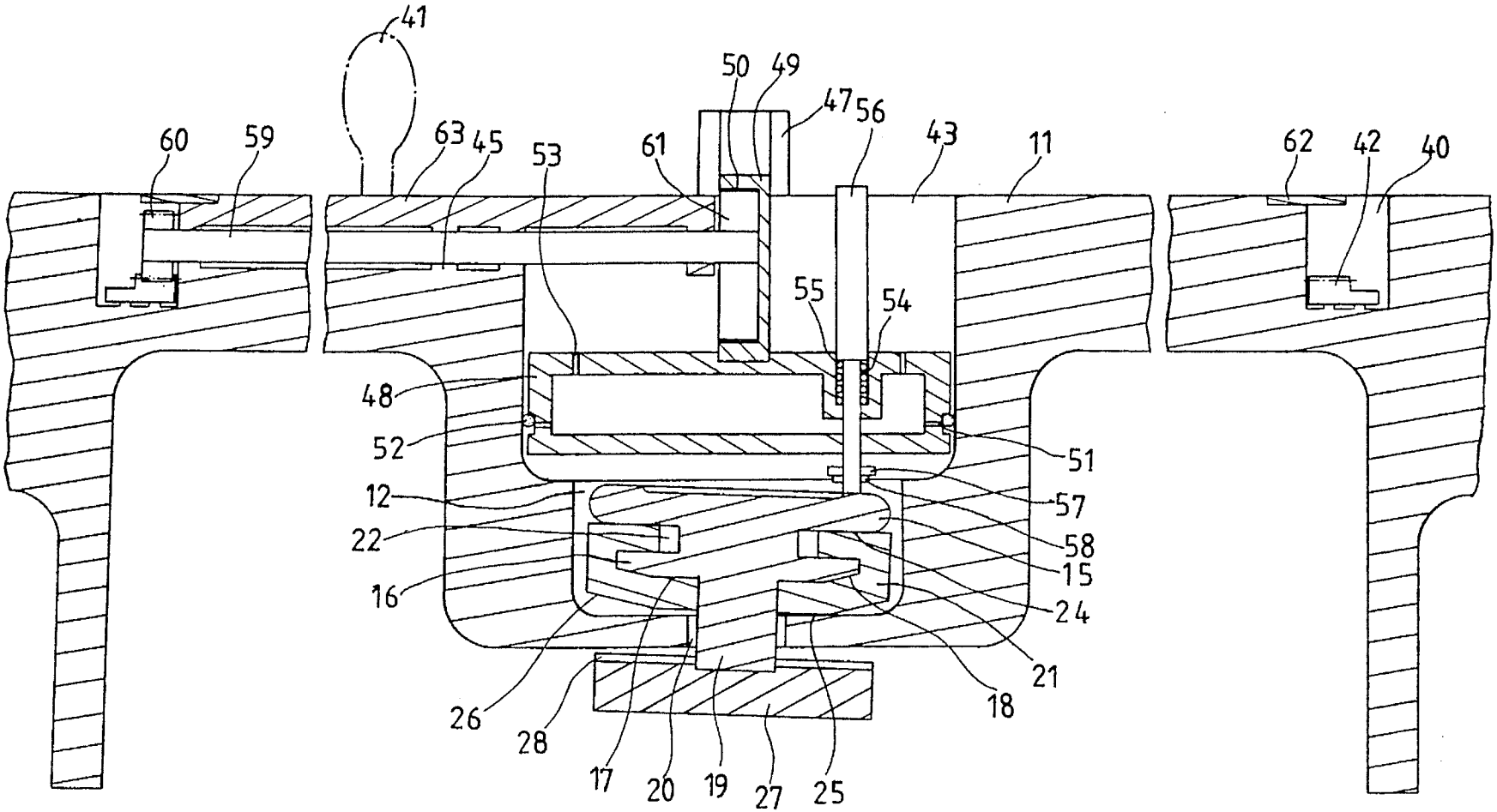
FIG. 11 shows a schematic view of the pressure leaking effect of the present invention as shown in FIG. 6.

When the air pump 48 is engaged in the action of exhausting air and moisture from the container 10, the pressure releasing rod 56 is prevented from making contact with the braking member 14 in view of the fact that the pressure releasing rod 56 is urged by the spring 55. The exhausting action of the air pump 48 can be brought to an end by pressing with a finger the pressure releasing rod 56 to make contact with the top of the braking member 14, as shown in FIG. 11.

Figure 2:
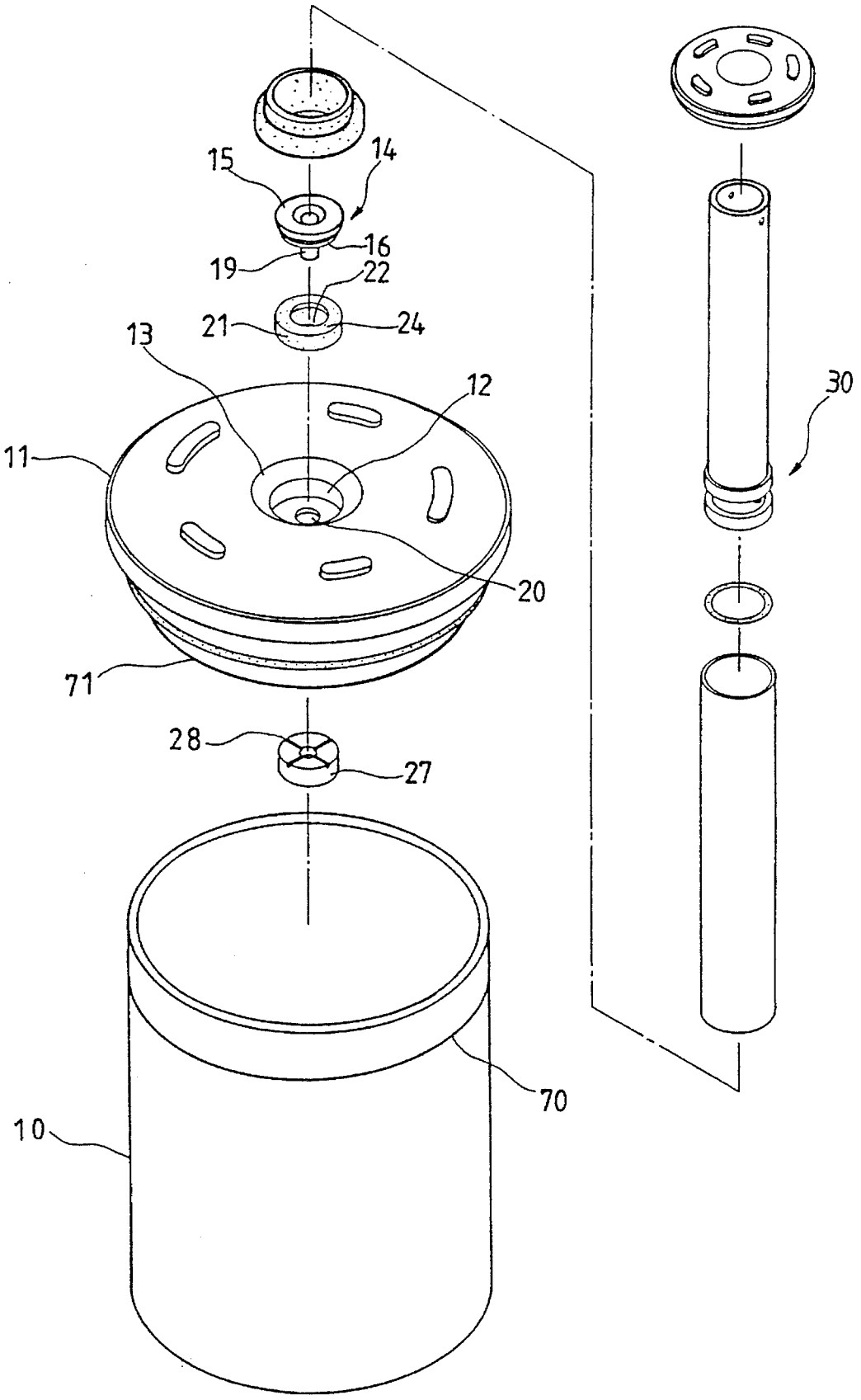
FIG. 2 shows an exploded view of the present invention.

As show in FIG. 2, the container 10 is provided around the brim thereof with a colored ribbon 70 while the lid 11 is provided around the bottom thereof with another colored ribbon 71. When the lid 11 and the container 10 are joined together, these two colored ribbons 70 and 71 are not overlapped each other. As the exhausting action is brought about by the device of the present invention to create a vacuum in the container 10, the colored ribbons 70 and 71 are caused to overlap each other by a gradual downward movement of the lid 11. The overlapping of the colored ribbons 70 and 71 is an indication that a vacuum is created in the container 10 and that the exhausting action of the device of the present invention can be therefore terminated.

What is claimed is:

1. A device for exhausting air and moisture from a container which comprises a lid provided with a receiving recess having a slot dimensioned to receive therein said device; wherein said device comprises:

a braking member disposed in said receiving recess such that said braking member is not is contact with a peripheral wall of said receiving recess, said braking member provided integrally on a top thereof with a pressing body and on a bottom thereof with a retaining body having centrally on a bottom thereof a flat surface and having peripherally a bevel, said retaining body further having centrally on said bottom thereof a columnar body passing through a through hole located centrally in a bottom of said receiving recess;

an airtight cushion of an elastic material and provided centrally with a longitudinal through hole, said airtight cushion further provided therein with a retaining space enabling said columnar body to be inserted into said airtight cushion from a top of said airtight cushion such that said columnar body is emerged from a bottom of said airtight cushion, and that said retaining body of said braking member is fitted into said retaining space of said airtight cushion, and further that said top of said airtight cushion is located between said pressing body of said braking member and said retaining body of said braking member, said airtight cushion provided centrally on a bottom surface thereof with a flat surface and further provided peripherally with a bevel, said flat surface of said airtight cushion being greater in size than said through hole of said receiving recess; and a locating block provided in a top thereof with a plurality of ventilation grooves opposite in location to said bottom surface of said airtight cushion, said locating block being fastened to said columnar body of said braking member so as to locate said device in said receiving recess in such a manner that said device can be caused to move up and down and that said device can be joined with an air pump or a rotatable air pump set so as to bring about an action of exhausting air and moisture from said container.

2. The device according to claim 1 wherein said rotatable air pump set comprises a toothed collar received in a round slot of said lid of said container, said receiving recess of said lid provided in a top thereof with an air pump receiving cell having an elongate slot extending from one side thereof toward said round slot, said air pump receiving cell further having on a top edge thereof tow protuberances which are opposite in location to each other and are provided respectively with a longitudinal guide slot so as to enable said air pump receiving cell to contain therein an air pump having on a top thereof a guide member, said guide member having two ends which are received respectively in said longitudinal guide slots of said two protuberances, said guide member further having horizontally an oval hole facing said elongate slot, said air pump provided peripherally with an air hole in communication with an air hole located in a top surface of said air pump, said air pump further provided thereunder with a cushion, said air pump still further provided in said top surface thereof with a fish-eye through hole dimensioned to receive therein a pressure releasing rod fitted into a biasing means, said pressure releasing rod having a bottom end fitted into a cushion and a washer and located a distance over said top surface of said braking member, said elongate slot of said lid being so dimensioned as to receive therein a control shaft having one end on which a gear engageable with said toothed collar is mounted, said control shaft further having another end on which an eccentric wheel is mounted, said eccentric wheel being received in said oval hole of said guide member, said round slot and said elongate slot being covered respectively with a covering ring and a locating piece for locating said toothed collar and said control shaft.

3. The device according to claim 1 wherein said container is provided around a brim thereof with a colored ribbon; wherein said lid is provided around a bottom thereof with a colored tape attached thereto; wherein said colored ribbon attached to said brim of said container and said colored tape attached to said lid are not overlapped each other when said lid is joined with said container; and wherein said colored ribbon and said colored tape are caused to overlap each other when a vacuum is created in said container.

* * * * *